US007327099B2

(12) United States Patent
Fischer et al.

(10) Patent No.: US 7,327,099 B2
(45) Date of Patent: Feb. 5, 2008

(54) BALLAST HAVING A DIMMING DEVICE

(75) Inventors: Klaus Fischer, Friedberg (DE); Josef Kreittmayr, Bobingen (DE)

(73) Assignee: Patent-Treuhand-Gesellschaft für elektrische Glühlamplen mbH, Munich (DE)

( * ) Notice: Subject to any disclaimer, the term of this patent is extended or adjusted under 35 U.S.C. 154(b) by 0 days.

(21) Appl. No.: 11/377,113

(22) Filed: Mar. 16, 2006

(65) Prior Publication Data

US 2006/0214605 A1 Sep. 28, 2006

(30) Foreign Application Priority Data

Mar. 22, 2005 (DE) ..... 10 2005 013 309

(51) Int. Cl.
*H05B 37/02* (2006.01)

(52) U.S. Cl. ..... 315/307; 315/DIG. 4; 315/224

(58) Field of Classification Search ..... 315/307, 315/291, DIG. 4, DIG. 2, 224, 301, 302, 315/308, DIG. 5
See application file for complete search history.

(56) References Cited

U.S. PATENT DOCUMENTS

| | | | | |
|---|---|---|---|---|
| 6,194,841 | B1 * | 2/2001 | Takahashi et al. | 315/224 |
| 6,198,236 | B1 * | 3/2001 | O'Neill | 315/307 |
| 6,307,765 | B1 * | 10/2001 | Choi | 315/DIG. 4 |
| 7,116,063 | B2 * | 10/2006 | Ohnishi et al. | 315/291 |

FOREIGN PATENT DOCUMENTS

| | | |
|---|---|---|
| DE | 39 43 350 A1 | 7/1991 |
| EP | 0 422 255 A1 | 4/1991 |

* cited by examiner

*Primary Examiner*—Douglas W. Owens
*Assistant Examiner*—Ephrem Alemu
(74) *Attorney, Agent, or Firm*—Cohen Pontani Lieberman & Pavane LLP

(57) ABSTRACT

A ballast having a dimming device for a low-pressure discharge lamp. For brightness control, the DC component of the periodically modulated envelope of the lamp current is varied. In this case, the current does not fall below predetermined minimum values for the lamp current. Phases with a high lamp current are characterized by a steep rising edge, compared with a flatter falling edge.

14 Claims, 3 Drawing Sheets

BALLAST HAVING A DIMMING DEVICE

FIELD OF THE INVENTION

The present invention relates to an electronic ballast having a dimming device for the purpose of controlling the lamp brightness of a low-pressure discharge lamp, and to a method for controlling the lamp brightness of a low-pressure discharge lamp.

BACKGROUND OF THE INVENTION

Electronic ballasts for operating low-pressure discharge lamps are known in many embodiments. They generally contain a rectifier circuit for the purpose of rectifying an AC voltage supply and charging a capacitor, often referred to as a smoothing capacitor. The DC voltage applied to this capacitor serves the purpose of supplying an inverter, which operates the low-pressure discharge lamp. In principle, an inverter produces, from a rectified AC voltage supply or a DC voltage supply, a supply power for the lamp which has a much higher frequency than the system frequency. Similar devices are also known for other lamp types, for example in the form of electronic transformers for halogen lamps.

Dimming devices for operating electronic ballasts for brightness control of low-pressure discharge lamps are known per se.

One known possibility for brightness control consists in adjusting the lamp power and thus the lamp brightness by regulating the amplitude of the lamp current. This can take place by means of bringing the operating frequency of the inverter closer to or further away from resonant frequencies of the lamp/inverter system.

SUMMARY OF THE INVENTION

One object of the present invention is to provide an electronic ballast which is improved in terms of lamp brightness control.

This and other objects are attained in accordance with one aspect of the invention directed to an electronic ballast having a dimming device for the purpose of controlling the brightness of a low-pressure discharge lamp. The electronic ballast is designed for operation of the low-pressure discharge lamp with periodically modulated lamp current. In order to control the lamp brightness, the dimming device is designed to adjust the lamp current as follows. With decreasing brightness, both the maxima and the minima of the envelope of the lamp current become smaller. With further decreasing brightness, the periodic modulation of the envelope of the lamp current is superimposed by a lower limit (MIN), optionally corresponding to zero, of the lamp current amplitude, resulting in periodic modulation of the envelope of the lamp current in lamp current pulse packets with lamp current amplitudes above the lower limit (MIN). With further decreasing brightness, the pulse packet widths decrease and the intervals between the pulse packets with the limited lamp current amplitudes (MIN) increase.

In order to control the lamp brightness, a feature of the invention provides for the high-frequency lamp current to be amplitude-modulated with a modulation signal and thus for the average lamp current to be varied.

Starting from the maximum brightness of the low-pressure discharge lamp, at least the minima and, at least above a specific brightness value, also the maxima of the envelope are reduced in order to reduce the brightness. The difference in amplitude between the minima and the maxima of the envelope of the lamp current can in this case be constant over a certain brightness range, but does not need to be. The shape of the modulation signal is preferably maintained in this brightness range. Only the DC component of the modulation signal is altered.

On a further reduction in the brightness, the minima of the envelope of the lamp current reach a lower boundary. The envelope does not fall below this lower boundary. The lower boundary may assume, depending on the embodiment of the invention, a positive, final value or else be set to zero. Between the phases with a higher envelope amplitude, there are thus phases in which the amplitude of the envelope of the lamp current corresponds to the value of the lower limit.

The phases in which the amplitude of the envelope is greater than the value for the lower limit define "pulse packets". These pulse packets are separated from one another by phases with a minimum envelope amplitude. A pulse packet in this case corresponds to a continuous period of time in which the amplitude of the envelope is greater than the minimum value and comprises two or more high-frequency lamp current oscillations. Between the pulse packets, the amplitude of the envelope corresponds to the lower limit, i.e. a high-frequency lamp current flows at the positive, final, lower limit. If the lower limit is set to zero, no lamp current flows.

If the brightness is reduced further, the temporal extent of the pulse packets decreases and the intervals between the pulse packets become longer.

In order to increase the brightness, the above pattern is used in reverse sequence, starting from lower brightnesses.

When operating a low-pressure discharge lamp with periodically modulated lamp current, the low-pressure discharge lamp is operated at a plurality of working points of the lamp voltage/lamp current characteristic, i.e. the lamp characteristic. During the phases with a lower lamp current, the working point is in a steeper region of the characteristic having higher voltages, while during the phases with a higher lamp current, the working point is in a flatter region of the characteristic having lower voltages, cf. FIG. 1 towards the left or towards the right.

The advantages of such an operating mode become clear when compared with brightness control by means of modulation-free amplitude adjustment of the lamp current.

At low brightnesses, no lamp currents flow without amplitude modulation, and the working point in FIG. 1 thus lies more to the left on the lamp characteristic. In this characteristic region, the lamp voltage is strongly dependent on the lamp current. If the brightness is reduced further, the lamp current is also reduced further, and the lamp voltage rises very severely. Primarily in the region of low continuous lamp currents, the dependence of the lamp voltage on the lamp current also has a very strong dependence on the temperature. At higher lamp currents, the lamp voltage is only slightly dependent on the lamp current.

Above a specific lamp voltage, the inverter can no longer continuously make the lamp voltage available.

When operating a low-pressure discharge lamp with periodically modulated lamp current, during the phases with a higher lamp current, the working point is in a region having less of a characteristic rise and lower operating voltages and, during the phases with a lower lamp current, the working point is in a region having a greater characteristic rise and higher lamp voltages. At low brightnesses, the low-pressure discharge lamp is operated in periodically recurring fashion only briefly in the critical region of low lamp currents, and the operating voltage in the process only rises slightly.

Lower brightnesses can thus be achieved than with unmodulated current because, in the phases with higher lamp currents, sufficient charge carriers are made available for the discharge and, as a result, complete recombination of the charge carriers is avoided in phases with very low lamp currents.

Embodiments of the invention may be provided in which the lamp current periodically completely disappears. However, charge carriers are maintained owing to the periodically recurring maxima of the envelope. Very low brightnesses can thus be achieved.

One preferred embodiment of the invention provides for the amplitude not to fall below a final minimum lamp current amplitude which should, however, preferably be so low that it only facilitates a rapid subsequent increase in amplitude.

In one further preferred embodiment, the envelope is limited in terms of high values. The envelope does not exceed a maximum value. Starting from low brightnesses, this means that, as the maxima and minima of the envelope of the lamp current increase, initially the maxima reach this upper boundary and then also do not exceed the corresponding value any more. A further increase in the brightness can be achieved by increasing the minima. Phases with a maximum value for the envelope are interrupted by minima in the envelope and its surrounding region. The maximum brightness is achieved if the amplitude of the envelope always assumes its maximum value corresponding to the upper boundary. This is basically a mirror-image procedure compared to the lower limit explained above.

When operating the low-pressure discharge lamp with modulated high-frequency lamp current, the rising edge of a phase with higher lamp current amplitudes is preferably relatively steep in comparison with the corresponding falling edge. A rapid reduction in the envelope of the lamp current does not correspond to the intrinsic dynamics of the system comprising the inverter and the low-pressure discharge lamp. Owing to the fact that many charge carriers are still provided in the discharge space of the low-pressure discharge lamp, the operating voltage of the low-pressure discharge lamp increases only slowly, and the inverter can continue to inject power into the low-pressure discharge lamp.

However, it is possible for there to be a rapid rise from low lamp currents to high lamp currents within a few lamp current oscillations, and the rising edges of the modulation can be very steep. At low lamp currents, the low-pressure discharge lamp damps the inverter only slightly, and it is possible for suddenly high voltages to be produced which result in a high lamp current. It is thus possible for a high lamp current to be built up very rapidly after phases with a relatively low lamp current.

One refinement of the invention is preferably designed to modulate the envelope of the lamp current in saw-tooth form or rounded saw-tooth form, the rising edge being markedly steeper than the falling edge.

The ratio between the peak value and the mean value of the lamp current, the crest factor, can be kept low by suitably selecting the amplitude deviation of the envelope of the lamp current. This leads one to expect a longer life for the system comprising the low-pressure discharge lamp and the inverter.

One refinement of the invention preferably has a signal generator for the purpose of generating a periodic signal and a circuit arrangement for the purpose of restricting the periodic signal. The restricted periodic signal is used as a guide variable for controlling the modulation of the lamp current. The signal is restricted by a lower barrier and possibly an upper barrier. The frequency response and the amplitude of the signal generated by the signal generator should preferably be capable of being matched to the respective refinement of the invention. For example, it may be expedient to make the frequency of the signal generated by the signal generator dependent on the working range, i.e. the mean lamp current. At low lamp currents, it may be expedient, for example, to increase the frequency of the sequence of maxima and minima of the envelope of the lamp current in order to give the charge carriers provided in the discharge less time for recombination in the case of a charge carrier density which is less in any case.

In one preferred refinement of the invention, the output signal from the signal generator is synchronized with the phase angle of the supply voltage of the inverter which is fluctuating at a low frequency owing to rectification of a system voltage, for example. It is thus possible to avoid any beat frequencies which may be perceived as flickering of the lamp brightness.

One preferred refinement of the invention provides for the inverter to be controlled via a closed-loop control circuit. For this purpose, the invention has a measuring device which measures the lamp current and converts it into a controlled variable. Alternatively, this measuring device can also measure the operating frequency of the inverter or another variable associated with the lamp current in order to convert it into a controlled variable. Furthermore, a regulator is provided. The regulator receives the controlled variable from the measuring device and a signal, which is related to the desired brightness, as an input signal (guide variable). The output signal from the regulator for controlling the inverter is determined from the controlled variable and the guide variable.

One further preferred refinement of the invention provides for a circuit arrangement for measuring the lamp resistance, for example as described in EP 0 422 255 B1. The measured variable is converted into a controlled variable, for example a voltage signal, and acts as an additional input to the regulator. In the case of a greatly increasing resistance of the discharge lamp, the regulator can drive the inverter such that interruption of the gas discharge owing to the increase in the lamp current is prevented.

Since the invention can manage without additional power components in the load circuit, it may be of compact design. The invention is therefore preferably suitable for integration of the electronic ballast in low-pressure discharge lamps, in particular compact fluorescent lamps (CFLs).

DETAILED DESCRIPTION OF THE DRAWINGS

Figure 1:
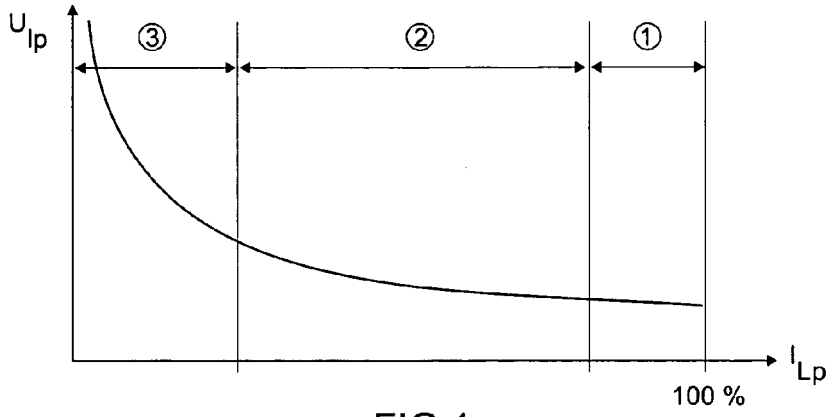
FIG. 1 shows the dependence of the lamp voltage of a low-pressure discharge lamp according to the invention on the lamp current.

FIG. 1 illustrates the lamp voltage of a low-pressure discharge lamp according to the invention as a function of the lamp current, i.e. the lamp characteristic. The lamp voltage initially increases only moderately, starting from a minimum at a maximum lamp current, when the lamp current is reduced; the dependence of the lamp voltage on the lamp current is low: brightness range 1 in FIG. 1. With a further reduction in the lamp current, the lamp voltage increases to an ever greater extent; the dependence of the lamp voltage on the lamp current becomes increasingly pronounced: brightness ranges 2 and 3 in FIG. 1. When the current falls below a minimum lamp current, the gas discharge is interrupted if the required voltage cannot be continuously provided by the inverter. The limited output voltage of the inverter thus defines the minimum lamp current at which the lamp can still be operated continuously, and thus the minimum brightness of the lamp with unmodulated lamp current.

As shown in FIG. 1 and in order to illustrate the concept according to the invention, the entire brightness range is divided into three brightness ranges.

In a first brightness range between the maximum possible brightness and an average brightness, the lamp current is modulated in saw-tooth form as the brightness decreases, the amplitude deviation of the saw-tooth modulation increasing as the brightness decreases, and the maxima of the saw tooth being "chopped" by an upper limit.

Figure 2A:
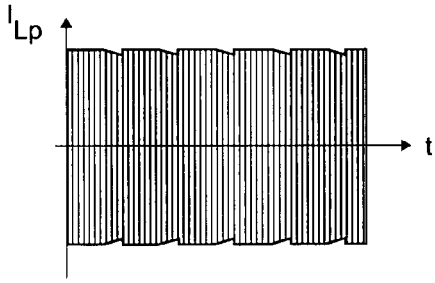
FIGS. 2*a-f* show the modulated lamp current at various lamp brightnesses of a low-pressure discharge lamp according to the invention.
Figure 2B:
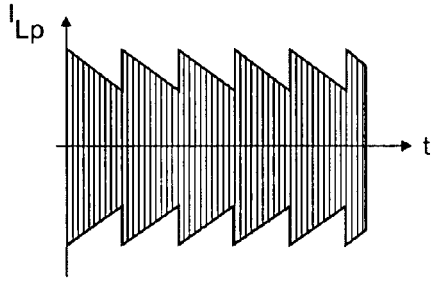

FIG. 2*a* shows the lamp current just below the maximum brightness; FIG. 2*b* shows the lamp current at a lower brightness than in FIG. 2*a*. It can be seen that the amplitude deviation of the saw-tooth modulation changes.

Following on from the end of the first brightness range, the brightness in a second range is reduced further. The amplitude deviation of the saw-tooth modulation is not changed, but the DC component of the modulation and the rms value of the lamp current decrease further owing to the reduction in the maximum lamp current amplitude, as shown in FIGS. 2*c* and 2*d*.

Figure 2C:
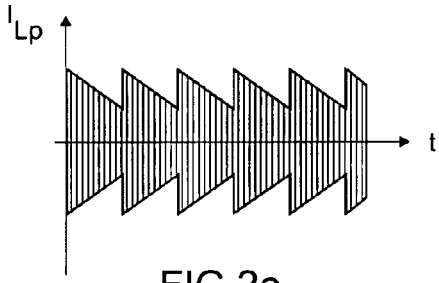
Figure 2D:
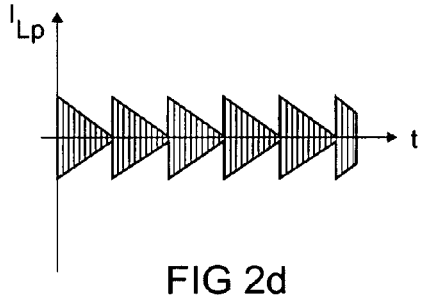

FIG. 2*c* shows the lamp current just at the boundary to the first brightness range; FIG. 2*d* shows the lamp current at a lower brightness than in FIG. 2*c*.

Following on from the second brightness range is a third brightness range. This extends up to the minimum brightness. The maximum amplitude of the lamp current is reduced further, the deviation of the saw-tooth modulation decreasing and the saw-tooth being chopped at values below the lower limit. Between the maxima of the envelope of the lamp current, the lamp current amplitudes assume a predeterminable minimum value (MIN). As a result, the envelope of the lamp current assumes a pulsed form. Each phase in which the amplitude of the envelope assumes a higher value than the minimum value (MIN) defines a pulse packet. The more the maximum current amplitude and thus the deviation are reduced, the longer the times with the minimum lamp current amplitudes. The minimum lamp current amplitudes may be very small or even equal to zero, with the result that no or virtually no lamp current flows. As the brightness decreases, the amplitudes in the pulse packets become smaller, the pulse packet durations become shorter, and the intervals between the pulse packets become longer. The frequency of the modulation signal may rise in this case.

Figure 2E:
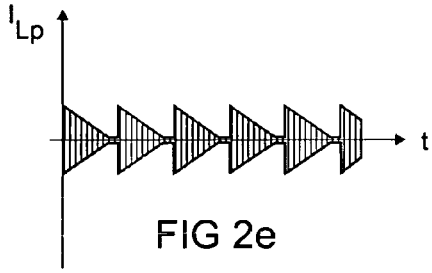
Figure 2F:
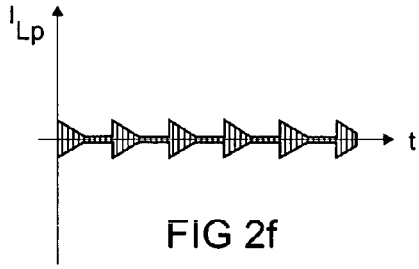

FIG. 2*e* shows the lamp current at a brightness close to the boundary to the second brightness range; FIG. 2*f* shows the lamp current at a lower brightness.

Figure 3:
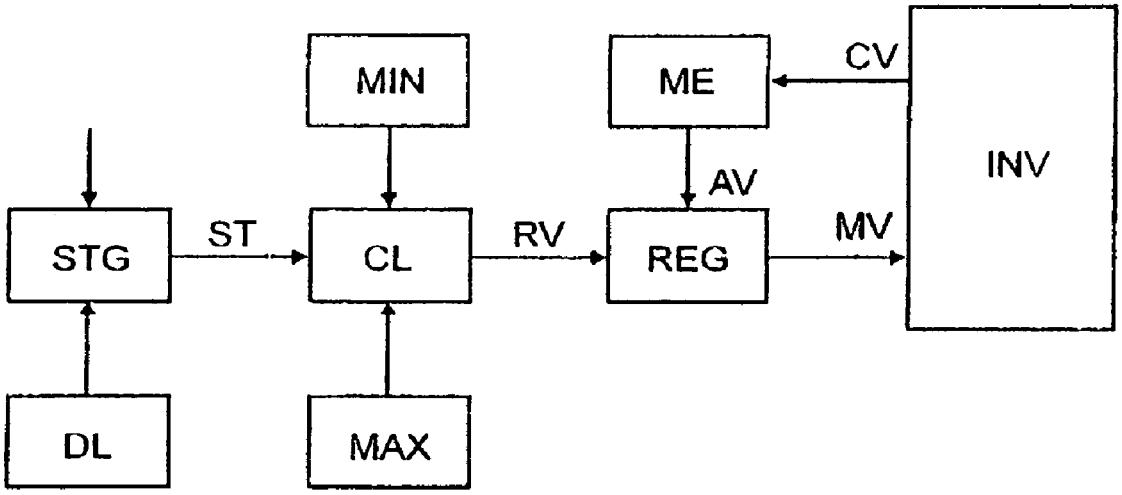
FIG. 3 shows a circuit arrangement according to the invention for controlling the lamp brightness.

FIG. 3 shows a circuit arrangement according to the invention for controlling the lamp brightness. A first signal DL, which has a very monotonic relationship with the desired brightness, is used to control the lamp brightness. This signal is supplied to a saw-tooth generator STG. The saw-tooth generator STG may be in the form of a self-oscillating circuit.

The signal DL determines the DC component of the saw-tooth signal, for example DL may be proportional to the DC component of the saw-tooth signal. The saw-tooth generator generates a signal ST which is supplied to a clamping circuit. The clamping circuit CL provides an output signal RV which is upwardly and downwardly limited. If ST assumes values which are greater than the value MAX, the output signal RV is restricted (clamped) to the value MAX. If ST assumes values which are less than the value MIN, RV is restricted (clamped) to the value MIN. The original signal ST can also be completely above the value MAX or below the value MIN. In these cases, the output RV of the clamping circuit CL corresponds to a constant signal having the value MAX or MIN.

The clamped saw-tooth signal RV is supplied to a regulator REG as a guide variable. The regulator REG may be in the form of a PI controller.

The regulator REG controls, via its output signal MV, the operating frequency of the inverter INV, which operates the low-pressure discharge lamp. The inverter INV also makes a variable CV available which is dependent on the lamp current. The variable CV may in this case be, in particular, the lamp current itself or the operating frequency of the inverter.

The measuring device ME produces, from the variable CV, a signal AV which is supplied to the regulator REG as a controlled variable.

The minimum value for the guide variable RV for the regulator REG corresponds to the value MIN. The value MIN should preferably not be selected to be too low from a control engineering point of view. The regulator REG should always be kept in an active operating state instead of allowing its output signal to be reduced (increased) to a final value dependent on the supply voltage of the regulator REG. This makes it possible to avoid greater transient phenomena in the case of a rising (falling) edge of the saw-tooth modulation signal.

Figure 4A:
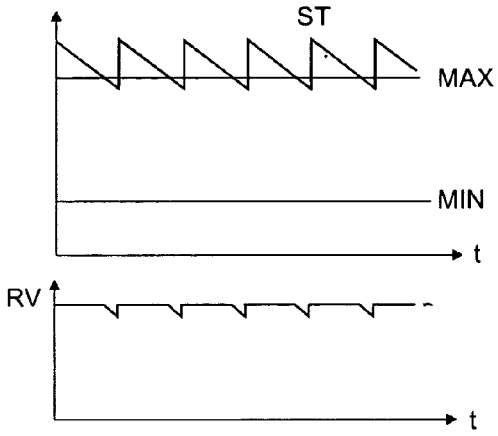
FIGS. 4*a-f* show how a modulated signal for the operation of a low-pressure discharge lamp is generated according to the invention.

FIGS. 4*a-f* show the change in the saw-tooth signal ST and the guide variable RV for the purpose of driving the regulator REG in the event of a change in the desired brightness from just below the maximum brightness to a low brightness. Close to the maximum brightness, a large proportion of the saw-tooth signal is above the maximum value MAX. Those parts of the saw-tooth signal which are above the value MAX are clamped to the value MAX. The clamping device CL produces the guide variable RV, which predominantly corresponds to the maximum value MAX. At times at which the signal ST is lower than the value MAX, the guide variable RV corresponds to the signal ST, as shown in FIG. 4*a*.

Figure 4B:
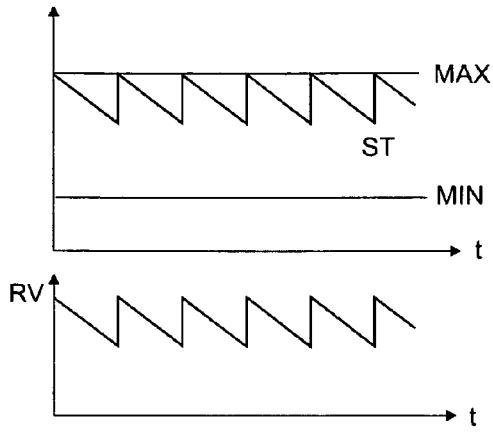

If the desired brightness is reduced, the DC component of the saw-tooth voltage ST is also reduced. The deviation of the amplitude modulation of the controlled variable RV is increased, but only up to a maximum value which corresponds to the deviation of the saw-tooth signal ST, as shown in FIG. 4*b*.

Figure 4C:
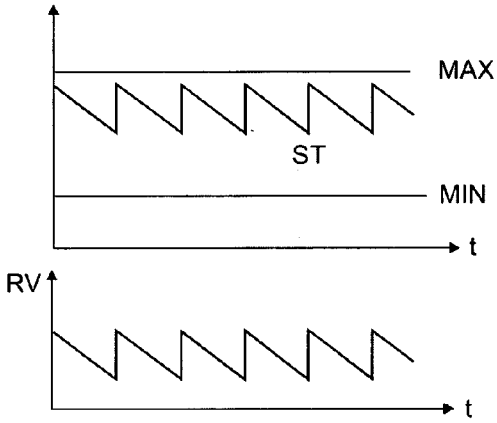
Figure 4D:
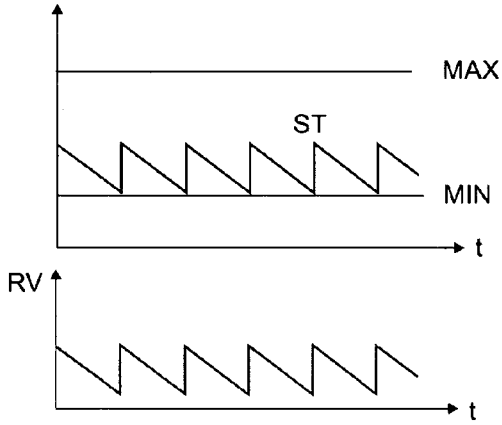

If the DC component of the saw-tooth voltage is reduced further, initially the deviation of the modulation of the guide variable RV is not changed, but its DC component is, as shown in FIGS. 4*c* and *d*.

Figure 4E:
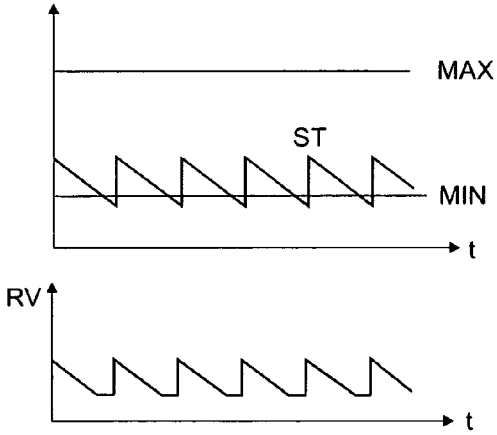
Figure 4F:
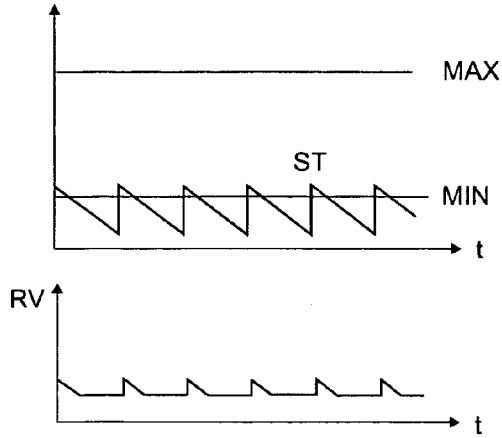

In the event of a further reduction in the brightness, phases occur in which the saw-tooth signal ST is decreased below the minimum value, defined by the value MIN, for the guide variable RV. During these phases, the guide variable RV is clamped to the minimum value MIN by the clamping circuit CL. The phases with decreasing DC component of the saw-tooth signal ST become longer, as shown in FIGS. 4*e* and *f*. If the saw-tooth signal ST is always less than the value MIN, the guide variable RV corresponds to the value MIN.

In the event that the inverter is supplied with an intermediate circuit voltage, this intermediate circuit voltage is generally not constant over time but has fluctuations corresponding to the periodicity of the supply system. The frequency of the modulation signal is much greater. This may result in beat frequencies which may be perceived as flicker on the low-pressure discharge lamp. In order to prevent this, the phase angle of the saw-tooth signal can be synchronized with the phase angle of the system frequency. For example, a suitable circuit makes it possible for a rising edge of the saw-tooth signal to always be produced at the time of the system maximum.

The value of the signal MIN should be kept as low as possible in order to be able to achieve brightnesses which are as low as possible. In the case of a low signal DL or MIN, the risk of the discharge being extinguished increases. In order to prevent this, the circuit known from EP 0 422 255 B1 can be used in order to measure the discharge resistance. If this discharge resistance increases severely, an interruption to the discharge is directly imminent. On the basis of the knowledge of the discharge resistance, an additional controlled variable can be supplied to the regulator REG so as to increase the lamp current if there is a threat of the lamp being extinguished.

We claim:

1. An electronic ballast having a dimming device for controlling brightness of a low-pressure discharge lamp configured for operation with a periodically modulated lamp current, comprising;

means for operating the dimming device to adjust the lamp current to control the lamp brightness such that with decreasing brightness levels, both a maxima and a minima of an envelope of the lamp current become smaller;

wherein with further decreasing brightness levels, the periodic modulation of the envelope of the lamp current is superimposed by a lower limit of an amplitude of the lamp current such that periodic modulation of the envelope of the lamp current occurs in lamp current pulse packets with lamp current amplitudes above the lower limit; and wherein with further decreasing brightness levels, widths of the pulse packets decrease and intervals between the pulse packets with limited lamp current amplitudes increase.

2. The electronic ballast as claimed in claim 1, wherein the dimming device is configured such that the lower limit corresponds to a positive value for the envelope of the lamp current.

3. The electronic ballast as claimed in claim 1, wherein the dimming device is configured such that the envelope of the lamp current is restricted by a maximum value at a high and maximum brightness level.

4. The electronic ballast as claimed in claim 1, wherein the dimming device is configured such that respectively rising edges of the periodic modulation are steep compared with the respectively falling edges.

5. The electronic ballast as claimed in claim 4, wherein the dimming device is configured to modulate the envelope of the lamp current in saw-tooth form or rounded saw-tooth form for controlling the brightness level.

6. The electronic ballast as claimed in claim 1, wherein the dimming device further comprises a signal generator for generating a periodic signal for modulation of the lamp current and a circuit arrangement for restricting the periodic signal corresponding to, if appropriate, a maximum boundary and the minimum boundary.

7. The electronic ballast as claimed in claim 1, wherein the dimming device includes a signal generator for generating a periodic signal for modulation of the lamp current and a device for synchronizing the periodic signal with a supply voltage of an inverter for producing the lamp current, the output signal from the signal generator being synchronized with a phase angle of the supply voltage of the inverter which is fluctuating at a low frequency.

8. The electronic ballast as claimed in claim 1, further comprising:

an inverter for producing the lamp current;

a measuring device for measuring the lamp current or a variable dependent on the lamp current and for producing a controlled variable; and a regulator controlled by the dimming device for controlling the inverter.

9. The electronic ballast as claimed in claim 8, further comprising:

a device for preventing interruption of gas discharge;

wherein the device is configured to measure resistance of the lamp and to convert the lamp resistance into an additional controlled variable.

10. A low-pressure discharge lamp having an integrated electronic ballast as claimed in claim 1.

11. A method for controlling brightness of a low-pressure discharge lamp by means of an electronic ballast having a dimming device configured for operation with a periodically modulated lamp current, comprising:

adjusting the lamp current such that with decreasing brightness, both a maxima and a minima of the envelope of the lamp current become smaller;

superimposing by a lower limit of an amplitude of the lamp current, with further decreasing brightness levels, a periodic modulation of an envelope of the lamp current such that periodic modulation of the envelope of the lamp current occurs in lamp current pulse packets with lamp current amplitudes above the lower limit; and decreasing widths of the pulse packets, with further decreasing brightness levels, and increasing intervals between the pulse packets with limited lamp current amplitudes.

12. The method as claimed in claim 11, wherein the method is implemented via the electronic ballast.

13. The method as claimed in claim 1, wherein the lower limit substantially corresponds to zero.

14. The method ballast as claimed in claim 11, wherein the lower limit substantially corresponds to zero.

* * * * *